United States Patent [19]

Wright

[11] 4,106,517

[45] Aug. 15, 1978

[54] DISHWASHER CONTROL SYSTEM WITH CYCLE RESELECT

[75] Inventor: Carl J. Wright, Bellbrook, Ohio

[73] Assignee: General Motors Corporation, Detroit, Mich.

[21] Appl. No.: 835,219

[22] Filed: Sep. 21, 1977

[51] Int. Cl.[2] ..... B08B 3/02

[52] U.S. Cl. ..... 134/58 D; 68/12 R; 307/141

[58] Field of Search ..... 134/57 D, 57 DL, 58 D, 134/58 DL; 68/12 R; 307/141, 141.4, 141.8

[56] References Cited

U.S. PATENT DOCUMENTS

| | | | |
|---|---|---|---|
| 3,125,105 | 3/1964 | Geiger | 134/58 D |
| 3,215,867 | 11/1965 | Mellinger | 307/141 |
| 3,246,182 | 4/1966 | Hanchett | 307/141 |
| 3,320,442 | 5/1967 | Todrank | 307/141 |
| 3,549,294 | 3/1970 | Kerr et al. | 134/58 D |
| 3,707,156 | 12/1972 | Athey et al. | 134/57 DL |

*Primary Examiner*—Robert L. Bleutge
*Attorney, Agent, or Firm*—Edward P. Barthel

[57] ABSTRACT

A dishwasher control system having a circuitry adapted to automatically drain the dishwasher whenever a selected cycle is user cancelled with user capability to immediately select another cycle. The circuitry includes a timer drain contact for energizing the pump and to drain the dishwasher at the end of all its selectable cycle. A momentary switch and alternate timer contacts are operable with any of the selected cycles to get out of the selected cycle by first energizing the rapid advance timer motor advancing the timer into the drain period where the user may reset the dishwasher to start a substituted cycle.

1 Claim, 4 Drawing Figures

DISHWASHER CONTROL SYSTEM WITH CYCLE RESELECT

This invention relates generally to an improved control means for an automatic dishwasher, and more particularly, to an improved dishwasher control system having circuitry enabling the user to start a substitute cycle without having to wait.

Prior art dishwasher control systems have utilized a selector switch with individually operated switches controlled manually by pushbuttons, such as "pots and pans", "normal soil", "quick wash", "rinse and hold", and "rinse and dry", together with a cancel button. In such systems the user initiates a cycle by pushing a selected button down beyond a latching position to a momentary position until the machine starts, after which the button is released and the machine automatically finishes the cycle. Such systems include a remote inaccessible timer with a rapid advance motor operative to take the machine through the selected cycle in approximately 18 to 20 seconds. In a typical operation the machine might take 90 minutes to run through a "pots and pans" cycle. In a case where the operator makes an error and desires to select another cycle, there is ordinarily no way of manually resetting the timer in the product. Thus, if an operator desires to change a selected cycle because of an error when it is first set, the operator depresses the cancel button so as to rapid advance the timer through the initially selected cycle and turns the product off. This necessitates the operator returning to the dishwasher to choose another substituted cycle. Further, in the event the operator forgot about cancelling a cycle water could remain in the dishwasher cabinet until the operator returns to again start the machine.

It is an object of the present invention to provide an improved control system for a dishwasher having a Cancel-Reset button for a selector switch such that when the Cancel-Reset button is depressed the machine is programmed to advance to one impulse before the machine turns itself off and proceeds to drain the machine at normal speed to remove the water from the machine obviating the possibility of retaining water in the washing compartment for an indefinite period of time.

Another object of the invention is to provide an improved dishwasher control system as recited in the first object whereby the operator may depress the Cancel-Reset button and upon waiting until the dishwasher starts its drain cycle and then depress the bottom of a substituted cycle thereby immediately starting the substituted cycle without having to wait for the machine to complete its previous operation and be turned off.

These and other objects of the present invention will be apparent as reference is had to the accompanying specification and drawings wherein.

Figure 1:
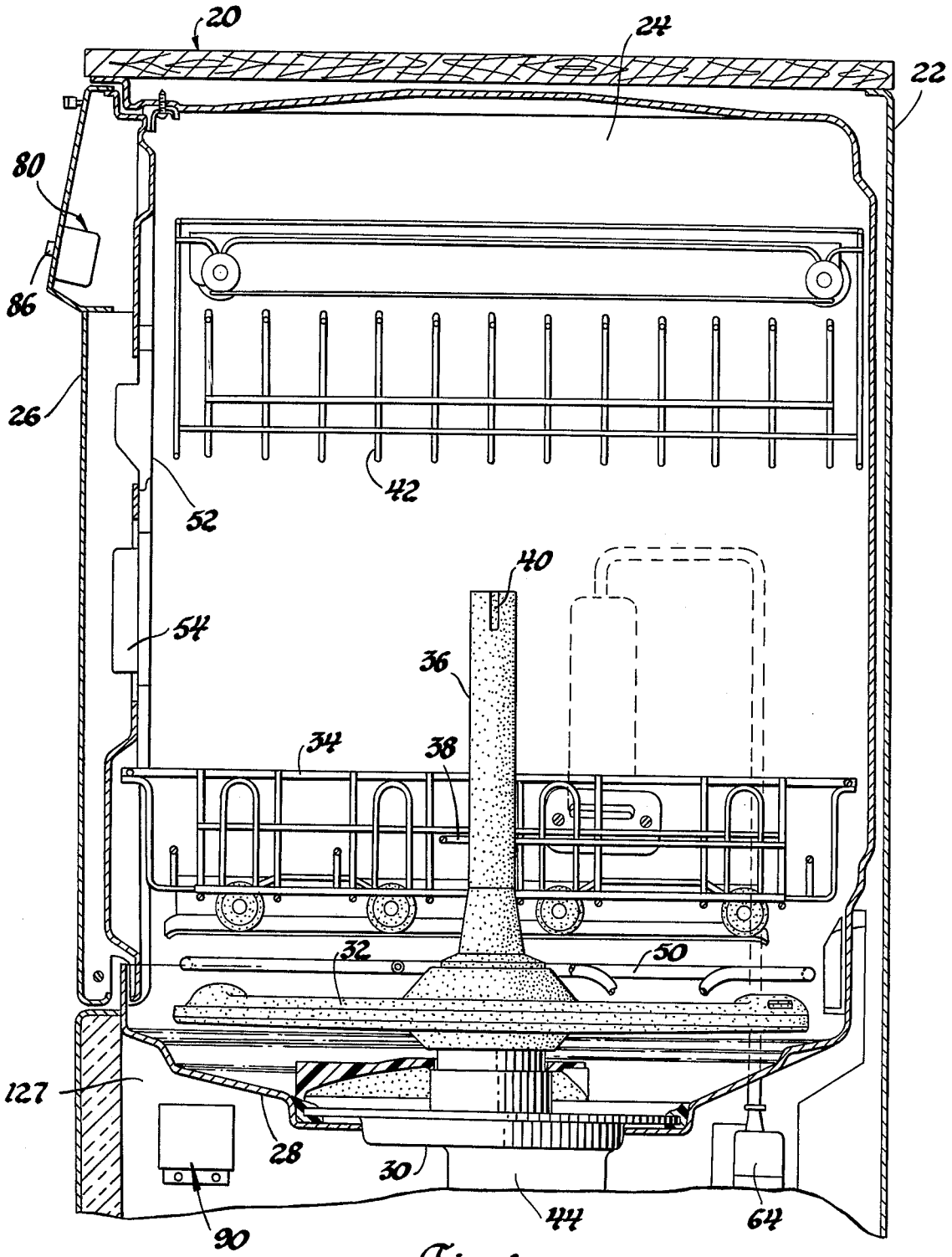
FIG. 1 is a side sectional view of a domestic dishwasher provided with the cancel-reset control system of this invention.

In accordance with this invention and with reference to FIG. 1, an improved dishwasher 20 is illustrated generally. The dishwasher 20 is comprised of casing means 22 defining a dishwashing chamber 24 having a front access opening closed by a dishwasher door 26. At the bottom of the chamber 24 is a depressed sump 28 leading to a pump motor assembly 30 such as the assembly shown in U.S. Pat. No. 3,265,311, issued August 9, 1966 and assigned to the assignee of the present application.

In general, the dishwasher water distribution system includes a revolvable spray arm 32 beneath the lower rack 34 supporting articles to be washed positioned on the racks. A rotating spray column or spray tube 36 is affixed to said spray arm and extends upwardly through a guard portion 38 of the lower rack. The spray tube has an outlet 40 adapted to project a spray generally upwardly through the support wire network to an upper dish rack 42. A reversible motor 44 in the pump motor assembly 30, having a main winding 45, (FIG. 3) directly drives the pump in one direction by means of WASH winding 46 being energized to recirculate the water for washing or rinsing. When the motor is reversed by means of DRAIN winding 47 being energized the motor 44 pumps the water to the drain. A heater 50 is periodically energized throughout the timed operating cycle to provide recovery heat to the wash and rinse water and for adding heat to the dishwashing chamber for the drying cycle.

Figure 3:
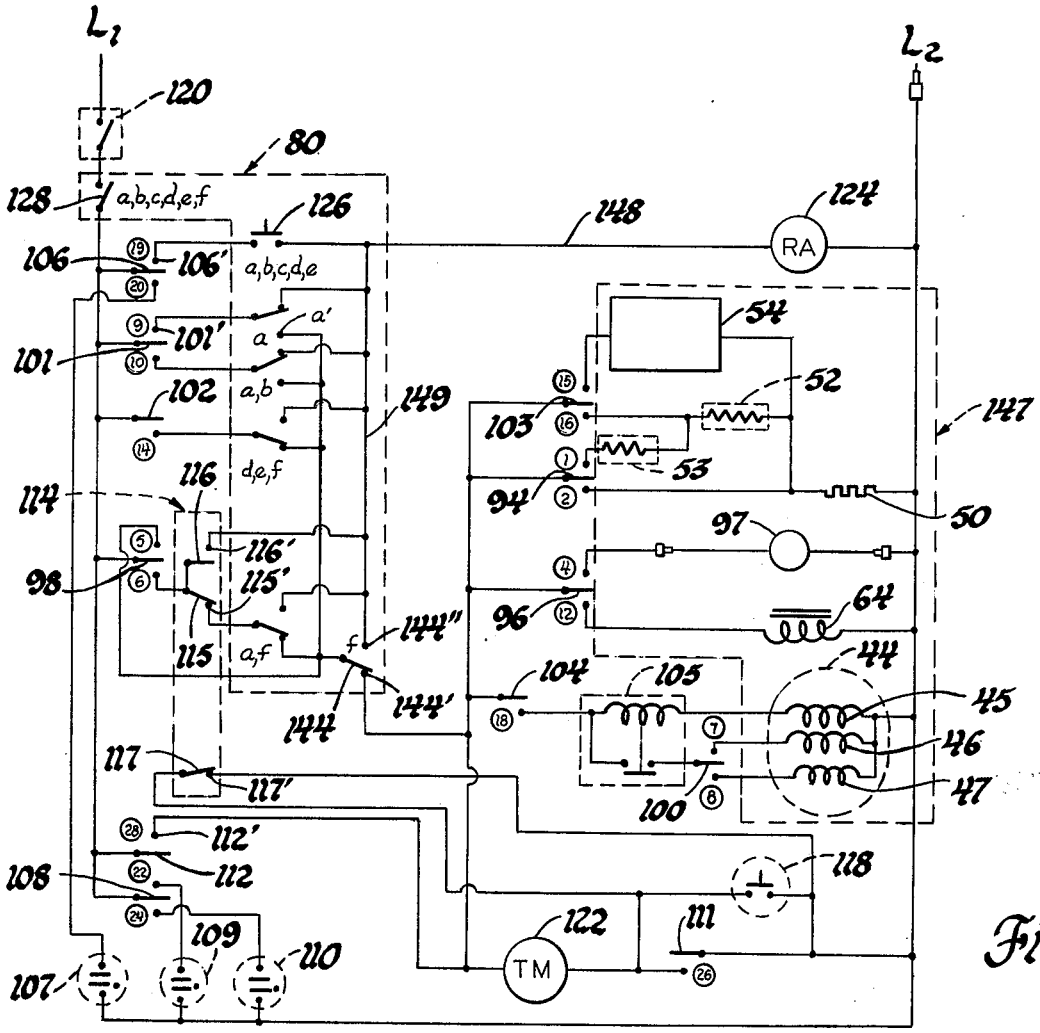
FIG. 3 is a schematic wiring diagram for operating the dishwasher of FIG. 1, in accordance with this invention.
Figure 4:
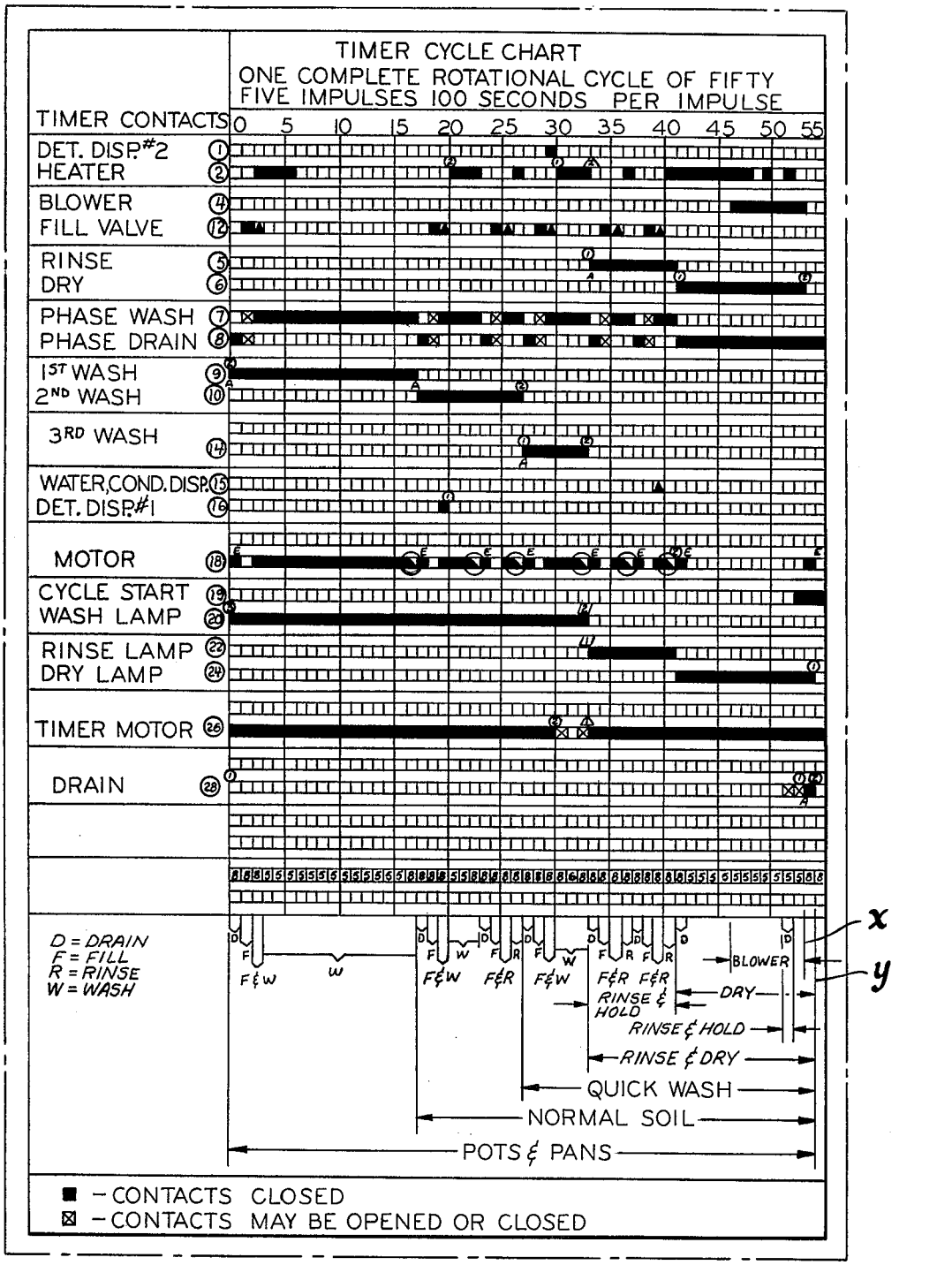
FIG. 4 is a timer cycle chart showing the functional relationships of the timer and selector switcher in FIG. 2.
Figure 4:
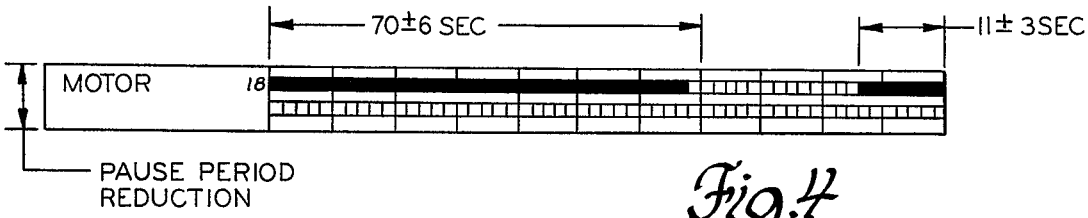

Various dispensers are periodically energized throughout the dishwashing cycle for providing desired washing and rinsing agents at effective points of the operating cycle represented by the timer cycle chart of FIG. 4. For example, bi-metal actuated detergent dispensers 52 and 53 and a solenoid actuated water conditioner dispenser 54 may be positioned on the inside panel of the dishwasher door 26 and electrically actuated through the control circuit of FIG. 3.

Water is supplied to sump 28 by means of a solenoid actuated water fill valve 64 through an opening in the dishwashing chamber 24. Specification for the fill valve calls for supply of water at a rate of 1.6 gallons per minute from a domestic water supply having supply pressures between 20 pounds per square inch (psi) and 120 psi. A suitable control such as a float control shown in U.S. Pat. No. 3,643,681, operates the fill valve 64 via timer switch 96 and is adapted to terminate fill when a predetermined normal water level is reached in the sump. The float control is designed to operate at heads of four inches of water in sump 28.

Figure 2:
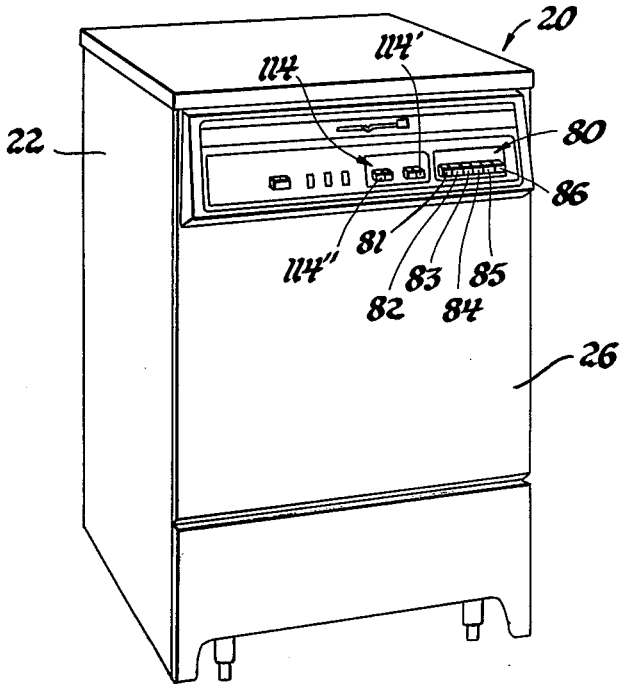
FIG. 2 is a perspective view of the dishwasher of FIG. 1.

The dishwashing cycle of dishwasher 20 is controlled by a push button cycle selector switch assembly generally indicated at 80 in FIG. 2. The cycle selector switch 80 is settable to provide a series of complete washing cycles by means of a plurality of push buttons 81–86 on the control panel which causes the various respective cycle selector switches a-f to operate when depressed.

The push button cycle selector switch assembly is settable to provide a series of complete washing cycles entitled "POTS AND PANS", "NORMAL SOIL", "QUICK WASH", "RINSE AND HOLD", "RINSE AND DRY", together with one "CANCEL-RESET" button for a purpose to be explained. In accordance with FIG. 3, it should be understood that the various internal switches a-f within the dashed outline of selector switch 80 move to a position opposite that shown when a cycle is selected which bears the number 81–86 shown alongside each letter switch a-f as follows:

81-*a*- POTS AND PANS
82-*b*- NORMAL SOIL
83-*c*- QUICK WASH
84-*d*- RINSE AND HOLD
85-*e*- RINSE AND DRY
86-*f*- CANCEL-RESET

The timer contacts for controlling the various dishwasher operating means listed on the Timer Cycle Chart of FIG. 4 are fhown by the corresponding encircled numbers in the schematic of FIG. 3. Thus, timer 90 includes a timer switch 94 operating between dispenser 53 timer contact one and heater timer contact two; timer switch 96 operating between blower 97 timer contact four and fill valve 64 timer contact twelve; timer switch 98 between rinse contact five and dry contact six; timer switch 100 operating to reverse the motor 44 between timer phase-wash recirculation contact seven and phase-drain contact eight; timer switch 101 operating between timer first wash contact nine and timer second wash contact ten, timer switch 102 operating to open and close timer third wash contact fourteen; timer switch 103 operating between timer water conditioner dispenser 54 contact fifteen and detergent dispenser 52 contact sixteen; timer switch 104 operating to open and close starting relay 105 contact eighteen; timer switch 106 operating between timer cycle start contact nineteen and timer wash lamp 107 contact twenty; timer switch 108 operating between timer rinse lamp 109 contact twenty-two and dry lamp 110 timer contact twenty-four; timer switch 111 operating to open and close timer motor contact twenty-six; and timer switch 112 operating to open and close timer drain contact twenty-eight.

An option selector switch assembly indicated generally at 114 on the control panel in FIG. 2 includes a HEATED DRY button 114' and an EXTRA HOT WATER TEMP button 114". As seen in FIG. 3, the button 114" operates a HEATED DRY double pole-double throw switch 115 and 116 having a "Yes" contact 115' and a "No" contact 116' respectively. The switch assembly button 114" operates an EXTRA HOT WASH TEMP single pole-single throw switch 117 having a NO position 117' and an open YES position. A water temperature thermostat is provided at 118 in the EXTRA HOT WATER TEMP circuit which upon opening at approximately 150° F. operates to restart a timer motor to be described.

It will be understood that in the dishwasher control system as described the operator's only visible means of determining the selected cycle is by observing which cycle selector switch button 81–85 has been depressed. As a consequence the operator desiring to initiate a particular cycle, such as the NORMAL SOIL cycle, pushes button 81 down about one-sixteenth of an inch beyond its latch position to a momentary position causing momentary switch 126 to close. Upon the dishwasher starting the operator removes his finger from button 81 allowing it so move outward to its latch position and the dishwasher automatically runs the selected cycle. It will be noted that the timer mechanism 90 is located out of view, such as at a lower position on the cabinet right side wall 127. The timer mechanism 90 is of conventional construction which in the disclosed form is a sequential impulse timer shown in U.S. Pat. No. 3,738,185 to Woolley. The timer 90 has a first normal speed motor shown at 122 in FIG. 3 which drives the timer mechanism through one impulse in a predetermined normal length of time, i.e. 100 seconds per impulse in the disclosed form. A second rapid advance motor 124 is capable of rotating the timer mechanism shift through a 360° cycle in about 18 to 20 seconds.

In conventional dishwashers having extended cycles such as a POTS AND PANS cycle, for example, a normal run time could be of the order of 90 minutes. Thus, if the operator inadvertently pushed a selector button for a POTS AND PANS cycle and desired to select another cycle, a cancel button would be pushed whereupon the rapid advance motor 124 would run through the POTS AND PANS cycle to the OFF position and turn the dishwasher off. Next the operator would return to the dishwasher and select a new cycle. With this prior art arrangement whatever function the dishwasher was performing, i.e. POTS AND PANS, NORMAL SOIL, etc., when the cancel button was pushed the dishwasher would rapid advance to its off position. Thus, if the prior art dishwasher chamber happens to be full of water and washing and the operator pushes its cancel button to cancel out the unwanted cycle the prior art dishwasher would stop with the water and a load of pots and pans, dishes, etc. still in the chamber. If the operator forgot about such a situation the water would remain in the dishwater chamber for an indeterminate length of time until the operator returned and restarted the dishwasher.

In applicant's present invention the prior art cancel button has been replaced by the CANCEL-RESET button 86. To cancel any unwanted cycle once the dishwasher has started, the dishwasher will automatically drain any water in the chamber 24 and then stop. This is achieved by having the dishwasher rapid advance to one impulse before the last OFF impulse by means of the second rapid advance motor 124 and then start a drain function at normal speed controlled by the timer first normal speed motor 122. As seen in FIG. 4 of the disclosed embodiment the dishwasher 20 will rapid advance through the fifty-third impulse at which point it will initiate the final drain impulse controlled by DRAIN timer contact twenty-eight shown on the chart by the single shaded impulse fifty-four.

With reference to FIG. 3 the cycle selector switch 80 will operate as follows: Upon the CANCEL-RESET button 86 being depressed after the starting of any cycle, cycle selector single pole-double throw switch 144 is caused to move from its lower fixed contact 144' to its upper fixed contact 144" resulting in the power being removed from all the dishwasher electrically operated elements shown enclosed by the dash-line box 147 in FIG. 3. With switch 144 closed to contact 144" the rapid advance motor 124 is energized through conductors 148 and 149, switch 144 fixed contact 144", and whatever combination of manually operated selector switches and cam operated timer switches provide a path to $L_1$ at any given time. Thus, for example, during the POTS AND PANS cycle with selector switch "*a*" closed to its contact *a'* and with timer switch 101 closed to its timer contact 101', the rapid advance motor circuit will be completed through these switches and via closed selector line switch 128 and door switch 120 to the $L_1$ side of the power source. A final path for the rapid advance motor 124 is provided via timer switch 98 being closed to its fixed contact 98', closed options selector switch 115, selector switch "*a,f*" closed to its lower fixed contact, and switch 144 closed to its upper contact 144"; whereby the timer mechanism will rapid advance to line 53 on the timer cycle chart of FIG. 4 and deenergize the rapid advance motor 124. At this point timer 90 energizes the normal speed first timer motor 122 through overriding timer drain movable 112 contacting its fixed contact 112'. The timer motor 122 will then start to run the next to last or fifty-fourth impulse before the fifty-fifth final OFF impulse at normal timer speed and commence to drain the dishwasher chamber. Said differently, the timer motor 122 will run through an impulse between the fifty-third pulse line "X" and the fifty-fourth pulse line "Y" at normal speed which will initiate a final drain of the dishwasher chamber 24.

It will be noted in the timer cycle chart of FIG. 4 that the first impulse of each dishwasher cycle, indicated by the letter D, is a drain function. Thus, once the dishwasher commences the final or fifty-fourth drain impulse through timer drain contact 28 and fixed contact 112' the circuit bypasses the dishwasher operating means 147 by virtue of completing a path directly to the $L_1$ side of the power source. The timer motor 122 now runs the dishwasher through the final drain pulse at the normal timer speed causing the chamber 24 to drain.

If, however, the user wishes to select a different cycle after cancelling any previous cycle, the user depresses the CANCEL-RESET button 86 and waits a moment until the timer rapid advance motor 124 rapid advances the timer cams to the final drain period initiated by cam twenty-eight. As soon as the chamber starts to drain the user immediately pushes the desired cycle button causing the momentary switch 126 to be closed until the WASH signal lamp 107 is energized. The closed momentary switch 126 energizes the rapid advance motor 124 through timer contact switch nineteen fixed contact 106' to $L_1$ thereby rapid advancing the timer through the final drain and off pulses to line "O" on the timer cycle chart and thence to the first impulse of the newly selected cycle which cycle will be started automatically. In this manner another cycle can be selected without the operator having to wait for the final drain period of the CANCEL-RESET to be completed. In addition applicant's improved control system will eliminate the possibility of the dishwasher chamber retaining water therein while allowing the user to immediately choose or reset another cycle.

While the embodiment of the invention as herein disclosed constitutes a preferred form, it is to be understood that other forms might be adopted.

I claim:

1. In an automatic dishwasher including a wash chamber adapted to receive washing fluid therein and articles to be cleaned by said washing fluid, a control system for operating said dishwasher including a plurality of timer switches controlled in sequence by a timer, a plurality of electrically operated elements including drain means controlled by said timer switches to perform at least a first washing cycle with said washing fluid, a second washing cycle with said washing fluid and a drain operation at the start of said cycles to remove any residue of washing fluid remaining from a previous washing cycle; an electrical power source for said control system; said timer electrically connected to said power source, said timer including a normal advance motor operative to drive said timer switches in said sequence in a first predetermined period of time and a rapid advance motor operative to drive said timer switches in said sequence in a second predetermined period of time relatively shorter than said first predetermined period, manually operated washing cycle selector switch means in said control system, said cycle selector switch means including a separate actuating member for selecting each of the cycles, each actuating member having a latched position and a momentary position for initiating operation of the selected cycle upon being moved by the user through said latched position to said momentary position and upon release by said user being returned to said latched position, whereby a momentary switch is closed momentarily causing said rapid advance motor to be energized to rapid advance said timer switches in said sequence to the start of the selected cycle and to preset said selector switch means for cooperation with said timer switches in operating the dishwasher through the selected cycle, the improvement wherein said timer switches include an overriding drain timer switch operative at one interval in said sequence to bypass said cycle selector switch means and said rapid advance motor to energize said normal advance motor and said drain means at the end of said cycles, and said selector switch means includes a cancel-reset actuating member having a latched position and operative therein to cancel out the remaining portion of any previously selected cycle by energizing said rapid advance motor to rapid advance said timer switches through said sequence to said one point, whereupon said rapid advance motor is deenergized, said drain timer switch initiating a drain operation by energizing said drain means to remove said washing fluid from said selected cycle and energizing said normal advance motor to control said timer switches during said drain operation to drain the wash chamber of said washing fluid and then deenergizing said drain means and the normal advance timer motor to terminate said selected cycle, and whereby during said drain operation the user may without waiting manually move a substitute actucting member of the selector switch means through its first latched position to its momentary position to initially close said momentary switch such that said rapid advance motor will rapid advance said timer switches through said one interval in said sequence to the start of said substitute cycle so that timer switches other than said drain timer switch may continue the drain operation at the start of said substitute cycle which was initiated by said drain timer switch at the end of said selected cycle, thereby to preclude any residue of washing fluid in said wash chamber either at the end or the start of said washing cycles.

* * * * *